United States Patent [19]

Frank

[11] 4,332,033

[45] Jun. 1, 1982

[54] ADJUSTABLE DRESS

[75] Inventor: Jonathan M. Frank, Chicago, Ill.

[73] Assignee: Uniforms To You & Co., Chicago, Ill.

[21] Appl. No.: 165,973

[22] Filed: Jul. 7, 1980

[51] Int. Cl.[3] ..... A41D 1/22

[52] U.S. Cl. ..... 2/105; 2/74

[58] Field of Search ..... 2/105, 73, 74, 75, 48, 2/52, 19; D2/82, 226

[56] References Cited

U.S. PATENT DOCUMENTS

| | | | |
|---|---|---|---|
| D. 127,643 | 6/1941 | Knebel | 2/106 X |
| 2,127,366 | 8/1938 | Mele | 2/74 |
| 2,431,466 | 11/1947 | Graig | 2/74 |
| 2,516,607 | 7/1950 | Wetzler | 2/106 |

FOREIGN PATENT DOCUMENTS

| | | | |
|---|---|---|---|
| 1004755 | 11/1951 | France | 2/106 |

*Primary Examiner*—Doris L. Troutman

*Attorney, Agent, or Firm*—Dressler, Goldsmith, Shore, Sutker & Milnamow, Ltd.

[57] ABSTRACT

An adjustable dress capable of fitting different size and shaped women. The dress is uniquely formed by front top portions and a front skirt joined by a midriff sash. Back yokes and a shoulder pattern are joined to the front. The back yokes provide the fullness of the back which adjusts to all sizes within a predetermined range. The arrangement and fullness of the patterns forming the dress allow for adjustment to the body within the garment. When the sash is tied by drawing it to the rear on each side, excessive fullness in the front is neatly and evenly draped in accordian fashion between the side seams at the rear by relocating excessive body fabric from the front to the rear where it is held neatly in place by the sash. The resultant dress forms an attractive garment on any size woman within the selected range of measurements.

12 Claims, 6 Drawing Figures

24a
68
70
78
66
76
54
36
16
74
80
34
56
24b
52
32

ADJUSTABLE DRESS

DESCRIPTION

1. Technical Field

This invention relates to garments, and more particularly, to an adjustable dress capable of fitting different size and shaped women within a selected range of height, waist, hip, bust, arm and neck measurements.

2. Background of the Invention

It is customary for restaurants to provide their waitresses with matching uniforms. There is a similar practice with respect to airline stewardesses, female bank employees, etc. Maintaining different size uniforms for employees is expensive, time consuming and burdensome and creates numerous administrative problems and loss of valuable storage space particularly in stores with large turnover of personnel.

Over the years, a variety of adjustable dresses and other garments have been developed. Typifying these dresses and garments are those shown in U.S. Pat. Nos. 1,209,018, 1,497,232, 2,136,983, 2,462,553, 2,507,602 and 2,666,920. These prior art dresses and garments have met with varying degrees of success. One particular type of dress that is particularly advantageous is that shown in U.S. Pat. No. 4,125,902 assigned to Uniforms To You & Co., the assignee of the present invention.

It is, therefore, desirable for dress manufacturers and wholesale and retail garment businesses to be able to offer a garment that will neatly fit a range of sizes and shapes of customers and to provide an improved dress which is attractive, comfortable, inexpensive to manufacture and easy to maintain.

SUMMARY OF THE INVENTION

An improved adjustable dress is provided that is capable of fitting different size and shaped women within a selected range of measurements. The novel dress is attractive, comfortable, inexpensive to manufacture and easy to maintain.

The adjustable dress of this invention is a "wrap-around both sides" dress or garment made from a front skirt and upper front portions joined by a midriff sash. In the preferred form, the patterns forming the left and right sides of the dress are expanded about a point of locus which would comfortably fit the average size woman who is expected to wear the dress. The upper front portions are arranged to fit the bust and waist of the largest woman within the range. The resultant fullness in the upper front portions are shirred into the shoulder portions and midriff. The front skirt is drafted in a similar manner and shirred to the midriff. The back yokes are also drafted by expanding the pattern and are shirred to the shoulder portions.

The shoulder portions arm holes, neck opening and skirt portion are cut and sewn to fit the shoulders, arms, neck and hips, respectively, of the largest woman within the range. The midriff is formed to fit around part of the waist of the smallest woman within the range.

A waist tightening belt tie, such as a one-piece midriff sash which crisscrosses around the back of the dress and is tied about the midriff, relocates excess body fabric from the front to the back to adjust the garment fit to any size woman within the chosen range of measurements.

A more detailed explanation of the invention is provided in the following description and appended claims taken in conjunction with the accompanying drawings.

DETAILED DESCRIPTION OF THE PREFERRED EMBODIMENT

Figure 1:
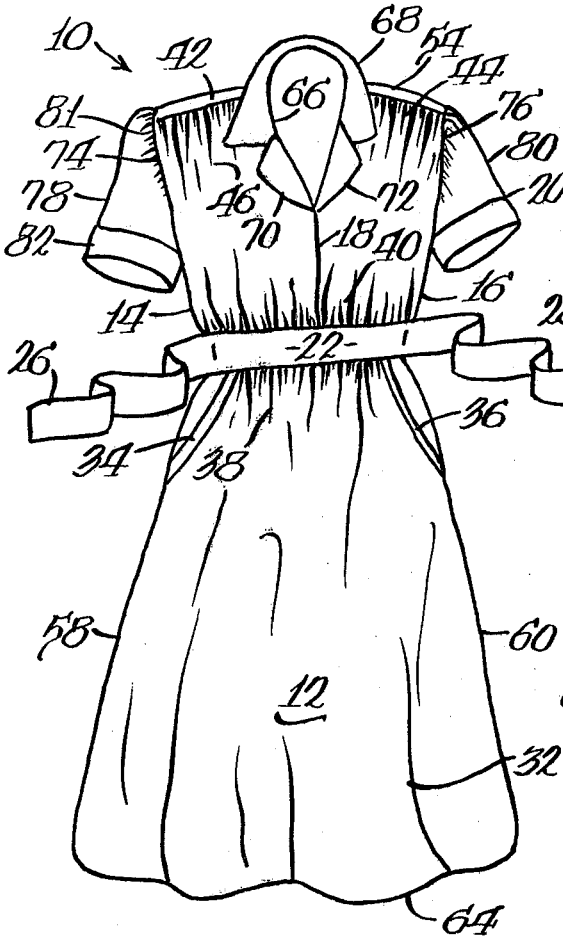
FIG. 1 is a front view of an adjustable dress in accordance with the principles of the present invention.

Referring to the drawings, an adjustable dress 10, sometimes referred to as a "fits all sizes wrap both sides" dress or a "pullover dress," fits different size and shaped women within a selected range of height, waist, hip, bust, arm, neck and shoulder measurements. For example, dress 10 covers dress sizes 4 to 12, with dress size 8 being the average size within the range and fits woman who are 5 feet to 5 feet 9 inches tall within the following range of measurements: waists from 24 inches to 31 inches, hips from 31 to 39 inches, busts from 30 to 37 inches, arms from 9 to 12½ inches wide, necks from 11 to 14 inches. Other sizes can be used.

Dress 10 is particularly useful in businesses where female employees wear matching uniforms or dresses, such as for waitresses, airline stewardesses, female bank employees, etc.

Dress 10 has a draped front 12 with right and left upper front top portions or patterns 14 and 16 that are sewn together along a vertical center seam 18. Front top patterns 14 and 16 are expanded from the smallest bust and waist sizes in the range to the largest bust and waist sizes within the range to accommodate the entire range of bust and waist measurements. Except for decoration or where otherwise stated in this application, all seams are sewn together along the inside of the dress and are either straight stitched or safety stitched.

Figure 7:
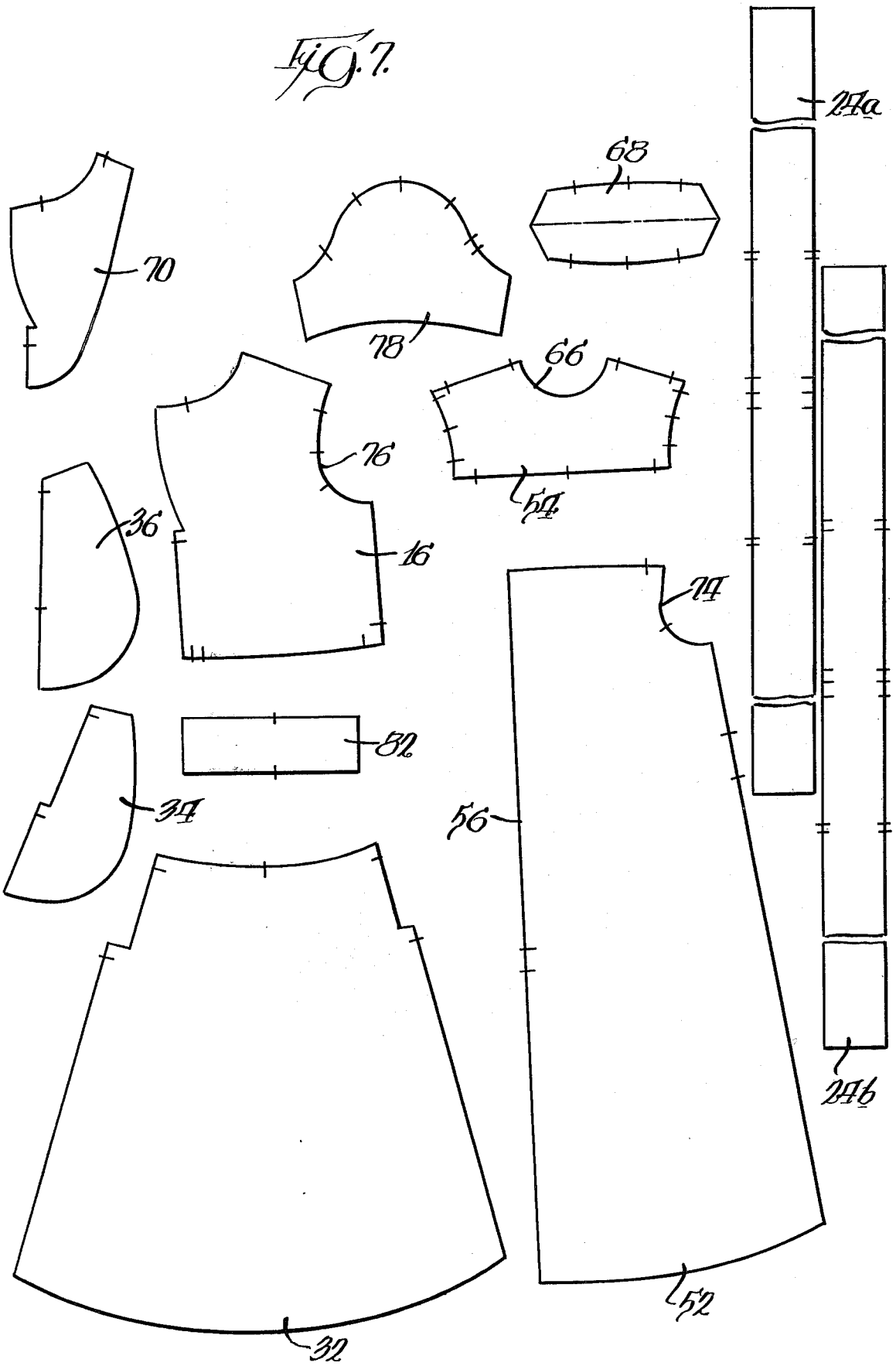
FIG. 7 is an assembly drawing of some of the patterns and parts of the adjustable dress illustrating the notches at which shirring begins and ends.

Top front portions 14 and 16 are gathered and sewn to the intermediate midriff or central portion 22 of a one-piece waist tightening midriff sash 24 along the upper midriff seam and forms gathered portions 40. Sash 24 is formed from two sash portions **24*a* and 24*b* (FIG. 7) which are sewn together along their edges and ends. Midriff portion 22 is of a length to fit around the midriff or front part of the smallest waist within the selected range of sizes and measurements. The elongated manually graspable end portions 26 and 28 (FIGS. 1 and 2) of sash 24 hang freely from midriff 22 when sash 24 is not tied. End portions 26 and 28 are of a sufficient length to crisscross around the back 48 of the dress and be tied together adjacent midriff 22** in the front of the dress to provide for multi-directional adjustment of all front pattern pieces.

Below midriff 22 is a front skirt 32 with pockets 34 and 36. Skirt 32 is gathered and sewn to the bottom of midriff 22 along the lower midriff seam to form gathered portions 38. Skirt 32 is expanded to accommodate the largest size waist and hip measurements within the chosen range.

The upper sections of top front portions 14 and 16 are gathered and sewn to shoulder portions or pattern 54 along front shoulder seams 42 and 44 to form upper gathered portions 46. Shoulder portions 54 fit the largest shoulders within the chosen range of sizes. Front shoulder seams 44 and 46 are located at the front 12 of dress 10 and appears properly positioned on any size person with the selected range of body measurements. This allows the shoulder to drape naturally on any size torso within the chosen range and avoids the use and mispositioning of conventional shoulder seams on top of the shoulders.

Gathered portions 38, 40 and 46 cooperate with each other to form draped portions along the front 12 of dress 10 and allow the front 12 to be expanded from the smallest to the largest size and accommodate the entire range of bust, waist and hip measurements.

Figure 2:
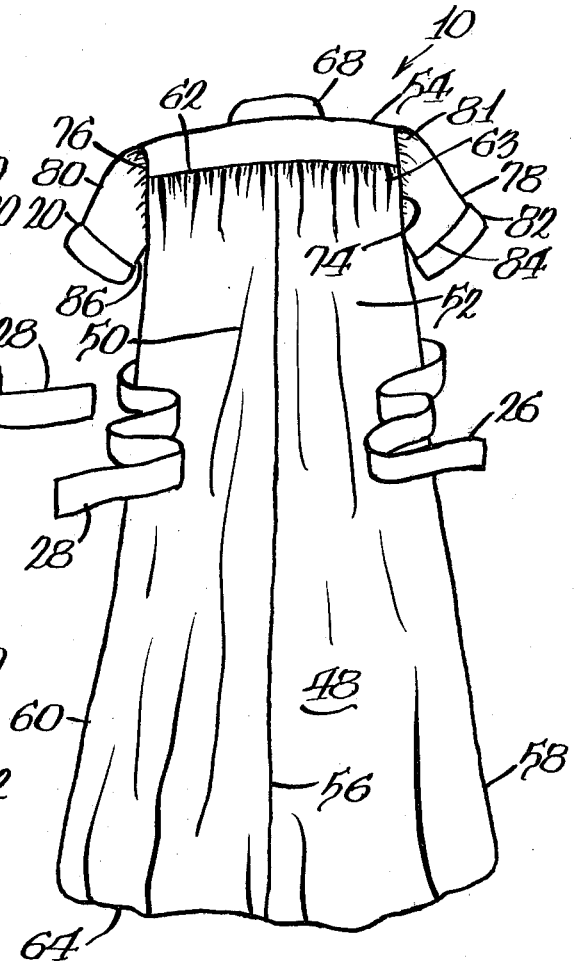
FIG. 2 is a back view of the adjustable dress.
Figure 3:
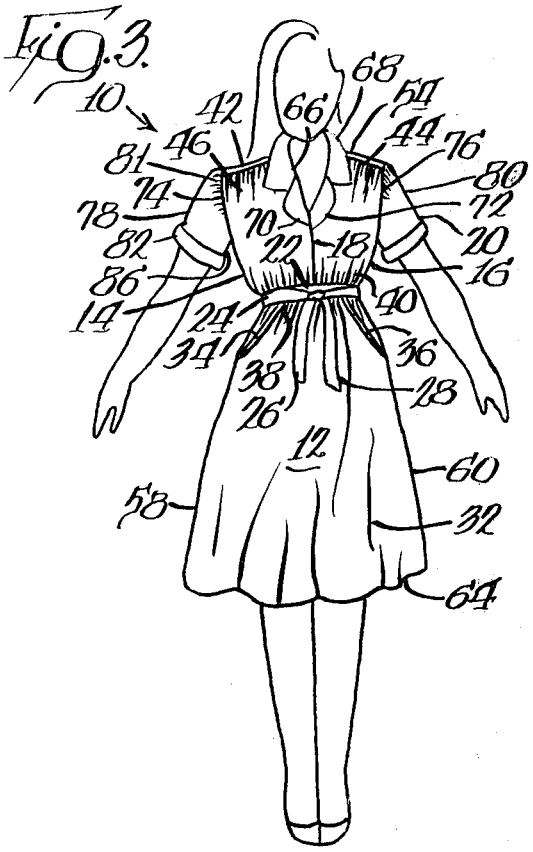
FIG. 3 is a front view of the adjustable dress worn by a petite woman.
Figure 4:
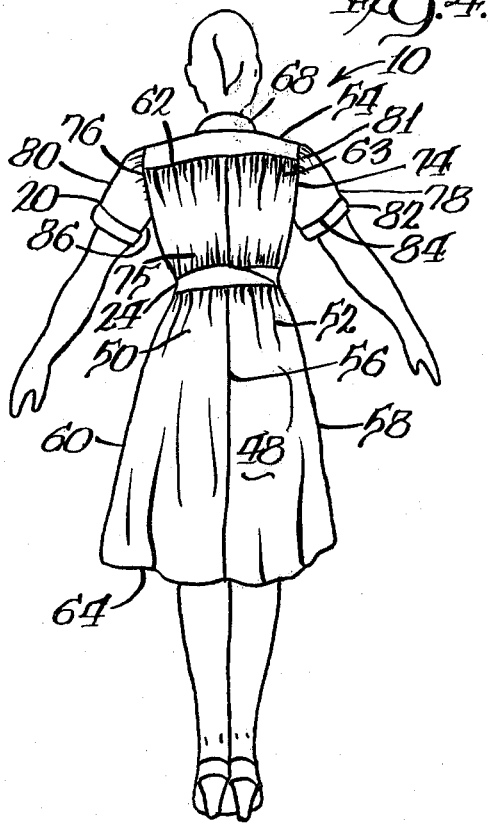
FIG. 4 is a back view of the adjustable dress worn by the petite woman.
Figure 6:
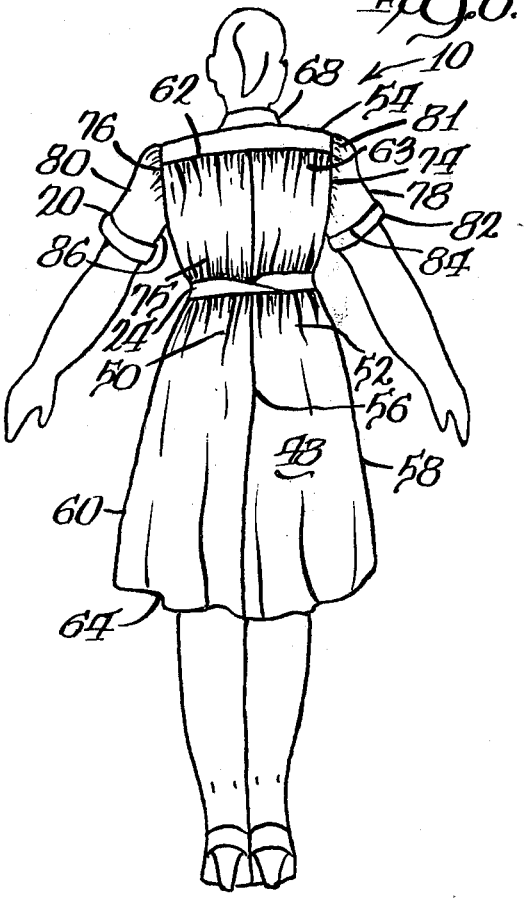
FIG. 6 is a back view of the adjustable dress worn by the large woman.

As shown in FIGS. 2, 4 and 6, dress 10 also has an expandable drapable back 48 of the same length as front 12. Back 48 has left and right back yokes 50 and 52 which fit the largest back and hip measurements within the selected range and are sewn together along a vertical back center seam 56 and to the front 12 of the dress 10 along side seams 58 and 60. Back yokes 50 and 52 are gathered and sewn to shoulder pattern 54 along back shoulder seam 62 to form gathered back portions 63 and maintain a clean appearance. The lower portion of the yokes 50 and 52 cooperate with the front skirt 32 to form the skirt portion of the dress. The bottom of the skirt is hemmed along hemmed bottom portion 64.

Figure 5:
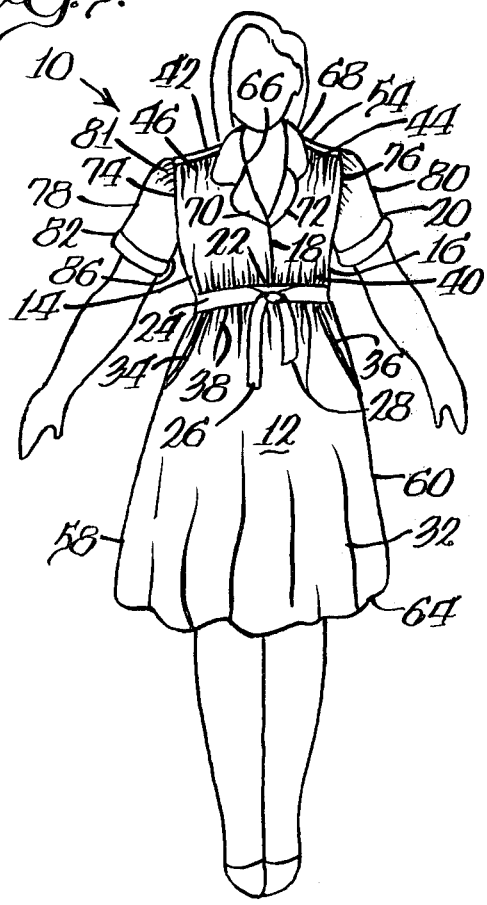
FIG. 5 is a front view of the adjustable dress worn by a large woman.

Dress 10 also has a neck opening 66 that is large enough to fit the neck of the largest woman within the chosen range and which is wide enough to eliminate the need for buttons, zippers and other fasteners along the front center seam 18. Neck opening 66 does not appear to be out of proportion of any torso in the range of size. In the illustrative embodiment, a collar 68 with lapels 70 are sewn to shoulder pattern 54 and top front portions 14 and 16 about neck opening 66. As best shown in FIG. 5, a reinforcing fabric 72 is sewn to the underside of lapels 70.

In the illustrative embodiment, dress 10 has puffed short sleeves 78 and 80 which are gathered and sewn to shoulder pattern 54 and top front portions 14 and 16 along arm hole seams 74 surrounding arm holes 76 to form gathered sleeve portions 81. Each puffed sleeve has a sleeve cap or cuff 82 at its end which is sewn to the main portion of the sleeve along cap seam 84. The major portion of each sleeve is sewn together along sleeve seam 86. Puffed sleeves 78 and 80 fit the longest and widest arms within the selected range. Sleeves 78 and 80 also maintain their shape on the smallest size arms within the range due to the rigidity of the sleeve part created when the sleeves are shirred down to the sides of the body sleeve opening.

In use, dress 10 is pulled on over the woman's head. Sash 24 is drawn rearwardly, crisscrossed around the back and tied about midriff 22. The degree of tension or tightness used will determine the amount snugness. When the sash 24 is tied, the fullness and positioning of the front pattern pieces allow for adjustment to the body within the garment. This self shaping action occurs as the fabric meets resistance from the body creating areas of friction with the stitch formation. The fabric drapes freely when no resistance is encountered. The resultant drawing and tying action of the sash 24 forms the dress to the body. Excess fullness is drawn to the rear by the action of the one piece midriff and sash by relocating excess body fabric from the front, equally on each side, to the rear. Such action might move the side seams slightly rearwardly depending on the torso size, with the lowermost portions of the side seams having a tendency to move the most. The fullness drawn to the rear is neatly and evenly draped in accordian fashion between the side seams at the rear and held in place by sash 24. Tightening of sash 24 about the back forms draped portions 75 (FIGS. 4 and 6) along the back 48 which complement the draped front 12.

Dress 10 maintains a similar general appearance when worn by any size woman within the chosen range of sizes.

While the illustrated dress is preferred, in some circumstances it may be desirable to have a sleeveless dress, a long sleeve dress or a collarless dress, or to have fewer pockets or a sash that ties in the back of the dress.

Although an embodiment of the invention has been shown and described, it is to be understood that various modifications and substitutions can be made by those skilled in the art without departing from the novel spirit and scope of this invention.

What is claimed is:

1. An adjustable dress capable of fitting different size women within a selected range of measurements which correspond to at least four consecutive dress sizes, said dress comprising: shoulder portions dimensioned for fitting the shoulders measurement of the largest woman within said selected range, arm holes dimensioned for fitting the arms measurement of the largest woman within said range, a neck opening dimensioned for fitting the neck measurement of the largest woman within said range, upper front portion means dimensioned for fitting the bust measurement of the largest woman within said range, a skirt portion dimensioned for fitting the hips measurement of the largest woman within said range, a midriff portion fixedly secured to and located between said skirt portion and said upper front portions and being of a length for fitting around part of the waist of the smallest woman within said range, said upper front portions, said midriff portion and said skirt portion cooperating to form the front of said dress, back means forming part of the back of said dress and connected to and cooperating with said front for fitting the measurement of the largest woman within said range and waist tightening means operatively associated with said midriff portion for relocating excess body fabric from the front to the back to adjust the garment fit of said dress to any size woman within said range.

2. An adjustable dress in accordance with claim 1 wherein said tightening means crisscross around said back and is tied about said midriff portion.

3. An adjustable dress in accordance with claim 1 wherein said upper front portions has gathered portions adjacent said shoulder portions.

4. An adjustable dress in accordance with claim 1 wherein said back means has gathered portions adjacent said shoulder portions.

5. An adjustable dress in accordance with claim 1 wherein said upper front portions has gathered portions adjacent said midriff portion.

6. An adjustable dress in accordance with claim 1 wherein said skirt portion has gathered portions adjacent said midriff portion.

7. An adjustable dress capable of fitting different size women within a selected range of measurements which correspond to at least four consecutive dress sizes, said dress comprising: shoulder portions dimensioned for fitting the shoulders measurement of the largest woman within selected range, arm holes dimensioned for fitting the arms measurement of the largest woman within said range, a neck opening dimensioned for fitting the neck measurement of the largest woman within said range, upper front portion means dimensioned for fitting the bust measurement of the largest woman within said range, a skirt portion dimensioned for fitting the hips measurement of the largest woman within said range, a midriff portion fixedly secured to and located between said skirt portion and said upper front portions and being of a length for fitting around part of the waist of the smallest woman within said range, said upper front portions, said midriff portion and said skirt portion cooperating to form the front of said dress, back yoke means forming part of the back of said dress and connected to and cooperating with said front dimensioned for fitting the measurement of the largest woman within said range, said back yoke means having gathered portions connected to said shoulder portions along a back shoulder seam, said upper front portions having gathered portions connected to said shoulder portions along a back shoulder seam, said upper front portions having gathered portions connected to said shoulder portions along a front shoulder seam at the front of said dress and having other gathered portions connected to said shoulder portions along a front shoulder seam at the front of said dress and having other gathered portions connected to said midriff portion, said front skirt portion having gathered portions connected to said midriff portion and waist tightening means operatively associated with said midriff portion for relocating excess body fabric from the front to the back to adjust the garment fit of said dress to any size woman within said range.

8. An adjustable dress in accordance with claim 7 further including sleeves dimensioned for fitting the measurement of the longest arms of the women within said range.

9. An adjustable dress in accordance with claim 8 wherein said sleeves have gathered portions connected to said shoulder portions.

10. An adjustable dress in accordance with claim 8 wherein said sleeves include puff sleeves.

11. An adjustable dress in accordance with claim 10 wherein said puff sleeves have shape-maintaining means for maintaining the shape of said puff sleeves on the arms of the smallest woman within said range.

12. An adjustable dress capable of fitting different size women within a selected range of measurements which correspond to at least four consecutive dress sizes, said dress comprising: shoulder portions dimensioned for fitting the shoulders measurement of the largest women within said selected range, arm holes dimensioned for fitting the arms measurement of the largest woman within said range, a neck opening dimensioned for fitting the neck measurement of the largest woman within said range, upper front portion means dimensioned for fitting the bust measurement of the largest woman within said range, a skirt portion dimensioned for fitting the hips measurement of the largest woman within said range, said skirt portion having at least one pocket, a sash having an intermediate midriff portion and elongated manually graspable end portions, said intermediate midriff portion fixedly secured to and located between said skirt portion and said upper front portions and being of a length for fitting around part of the waist of the smallest woman within said range, said upper front portions, said midriff portion and said skirt portion cooperating to form the front of said dress, back yoke means forming part of the back of said dress and connected to and cooperating with said front dimensioned for fitting the measurements of the largest woman within said range, said back yoke means having gathered portions connected to said shoulder portions along a back shoulder seam, said upper front portions having gathered portions connected to said shoulder portions along a front shoulder seam at the front of said dress and having other gathered portions connected to said midriff portion, said front skirt portion having gathered portions connected to said midriff portion, puff sleeves dimensioned for fitting the measurement of the longest arms of the women within said range, said sleeve having gathered portions connected to said shoulder portions and shape-maintaining means for maintaining the shape of said puff sleeves on the arms of the smallest woman within said range, and a collar and a lapel about said neck opening, said elongated end portions being of a length to criss-cross around said back and be tied about said midriff portion for relocating excess body fabric from the front to the back in a draped accordion fashion to adjust the garment fit of said dress to any size woman within said range.

* * * * *